US009314118B2

(12) United States Patent
Blazar et al.

(10) Patent No.: US 9,314,118 B2
(45) Date of Patent: Apr. 19, 2016

(54) COMFORT CUSTOMIZABLE PILLOW

(75) Inventors: Joseph E. Blazar, Owensboro, KY (US); Gary M. Wahrmund, Fort Worth, TX (US)

(73) Assignee: Jiajing USA, Inc., Richmond (CA)

( * ) Notice: Subject to any disclaimer, the term of this patent is extended or adjusted under 35 U.S.C. 154(b) by 352 days.

(21) Appl. No.: 13/553,276

(22) Filed: Jul. 19, 2012

(65) Prior Publication Data

US 2013/0019409 A1 Jan. 24, 2013

Related U.S. Application Data

(60) Provisional application No. 61/509,377, filed on Jul. 19, 2011.

(51) Int. Cl.

| | |
|---|---|
| ***A47C 20/00*** | (2006.01) |
| ***A47G 9/10*** | (2006.01) |
| *A47G 9/00* | (2006.01) |

(52) U.S. Cl.

CPC ..... *A47G 9/1027* (2013.01); *A47G 9/10* (2013.01); *A47G 2009/003* (2013.01); *A47G 2009/1018* (2013.01)

(58) Field of Classification Search

CPC ..... A47G 9/10; A47G 2009/1018; A47G 9/1027; A47G 2009/003

USPC ..... 5/636, 637, 638, 644, 645, 652, 652.1, 5/654, 655.3, 655.5

See application file for complete search history.

(56) References Cited

U.S. PATENT DOCUMENTS

| | | | | |
|---|---|---|---|---|
| 265,615 | A | | 10/1882 | Laskey |
| 509,081 | A | | 11/1893 | Harding |
| 609,819 | A | | 8/1898 | Lawrence |
| 613,328 | A | | 11/1898 | Shyrock |
| 722,135 | A | | 3/1903 | Nunan |
| 1,262,510 | A | | 4/1918 | Kelly |
| 2,068,134 | A | * | 1/1937 | Houghton ..... 5/708 |
| 2,826,767 | A | * | 3/1958 | Edwards ..... 5/644 |
| 2,886,834 | A | * | 5/1959 | Gilbertson ..... 5/709 |
| 2,942,281 | A | | 6/1960 | Cole |
| 3,058,122 | A | | 10/1962 | McDaniel et al. |
| 3,118,153 | A | | 1/1964 | Hood |
| 3,867,732 | A | | 2/1975 | Morrell |
| 3,872,525 | A | * | 3/1975 | Lea et al. ..... 5/671 |
| 3,943,583 | A | | 3/1976 | Ishikawa |
| 4,025,974 | A | | 5/1977 | Lea et al. |
| 4,190,286 | A | | 2/1980 | Bentley |
| 4,267,611 | A | | 5/1981 | Agulnick |
| 4,528,705 | A | | 7/1985 | Greenawalt |
| 4,624,877 | A | | 11/1986 | Lea et al. |

(Continued)

FOREIGN PATENT DOCUMENTS

| | | |
|---|---|---|
| WO | WO 2013139857 | 9/2013 |
| WO | WO 2013152404 | 10/2013 |

*Primary Examiner* — Peter M Cuomo
*Assistant Examiner* — David E Sosnowski
(74) *Attorney, Agent, or Firm* — Conley Rose, P.C.; Kristin Jordan Harkins

(57) ABSTRACT

Embodiments typically might relate to pillows that are comfort customizable based on user preference. For example, embodiments might include an outer casing and a self-inflating inner core. A user might adjust the firmness and/or thickness of the pillow by altering the amount of fluid, such as air, within the inner core. Typically such adjustments might be performed without use of a pump, given the self-inflating nature of the inner core.

20 Claims, 7 Drawing Sheets

(56) References Cited

U.S. PATENT DOCUMENTS 4,707,027 A 11/1987 Horvath et al.
4,788,729 A 12/1988 Walker
4,807,313 A 2/1989 Ryder et al.
4,821,348 A 4/1989 Pauna
4,914,766 A * 4/1990 Moore ..... 5/644
4,953,247 A 9/1990 Hasty
4,995,124 A 2/1991 Wridge, Jr. et al.
5,023,967 A 6/1991 Ferrand
5,033,133 A * 7/1991 Nissen ..... 5/653
5,060,325 A 10/1991 Carnahan et al.
5,077,845 A 1/1992 Tokunaga et al.
5,090,077 A 2/1992 Caden et al.
5,138,729 A 8/1992 Ferrand
5,152,018 A 10/1992 Lea
5,185,897 A 2/1993 Van Laanen
5,231,720 A 8/1993 Benoff
5,249,318 A 10/1993 Loadsman
5,267,363 A 12/1993 Chaffee
5,282,286 A 2/1994 MacLeish
5,287,577 A 2/1994 Bremer et al.
5,345,629 A 9/1994 Ferrand
5,367,726 A 11/1994 Chaffee
5,419,347 A 5/1995 Carruth
5,421,044 A 6/1995 Steensen
5,452,487 A * 9/1995 Leggett ..... 5/709
5,491,854 A 2/1996 Music
5,542,136 A 8/1996 Tappel
5,588,168 A 12/1996 Byrne et al.
5,634,225 A 6/1997 Miller, Sr. et al.
5,647,079 A 7/1997 Hakamiun et al.
5,689,844 A 11/1997 Liu
5,702,536 A 12/1997 Carruth
5,705,252 A 1/1998 Lea et al.
5,745,941 A 5/1998 Miller, Sr.
5,802,640 A 9/1998 Ferrand et al.
5,904,172 A 5/1999 Gifft et al.
5,991,949 A 11/1999 Miller, Sr. et al.
6,003,745 A * 12/1999 Mechanic ..... 224/156
6,012,188 A 1/2000 Daniels et al.
6,014,783 A 1/2000 Collier et al.
6,016,582 A 1/2000 Larson
6,038,722 A 3/2000 Giori et al.
6,108,835 A * 8/2000 Hwang ..... 5/420
6,108,844 A 8/2000 Kraft et al.
6,119,292 A 9/2000 Haas
6,151,735 A 11/2000 Koby et al.
6,161,231 A 12/2000 Kraft et al.
6,219,868 B1 * 4/2001 Wang ..... 5/709
6,269,505 B1 8/2001 Wilkinson
6,317,908 B1 11/2001 Walpin
6,397,419 B1 6/2002 Mechache
6,401,279 B1 6/2002 Vaughn
6,446,289 B1 * 9/2002 Su et al. ..... 5/709
6,481,033 B2 11/2002 Fogel
6,483,264 B1 11/2002 Shafer et al.
6,487,739 B1 12/2002 Harker
6,505,368 B1 1/2003 Ellis et al.
6,592,184 B1 7/2003 Segal et al.
6,651,277 B1 11/2003 Marson
6,658,827 B2 12/2003 Brownlie
6,668,408 B2 12/2003 Ferrand et al.
6,684,433 B2 2/2004 Giori et al.
6,684,434 B2 2/2004 Ellis et al.
6,687,937 B2 2/2004 Harker
6,691,348 B2 2/2004 Plummer et al.
6,721,980 B1 4/2004 Price et al.
6,725,485 B2 4/2004 Hayes
6,745,420 B2 6/2004 Giori et al.
6,771,190 B2 * 8/2004 Gordon ..... 340/999
6,826,795 B2 12/2004 Wilkinson
6,912,748 B2 * 7/2005 VanSickle ..... 5/654
6,922,863 B2 8/2005 Giori et al.
6,951,038 B1 10/2005 Ganoe, Sr.
6,988,286 B2 1/2006 Schecter et al.
7,051,389 B2 5/2006 Wassilefky
7,086,104 B1 8/2006 Tsay
RE39,408 E 11/2006 Wang
7,141,131 B2 11/2006 Foxen et al.
7,328,472 B2 * 2/2008 Chaffee ..... 5/706
7,415,742 B2 8/2008 Wassilefsky
7,475,440 B2 1/2009 Chaffee
7,480,952 B2 1/2009 Nickerson et al.
7,506,390 B2 3/2009 Dixon et al.
7,513,002 B2 4/2009 Best
7,530,127 B2 5/2009 Leifermann et al.
7,600,277 B2 10/2009 Heimbrock
7,698,765 B2 4/2010 Bobey et al.
7,735,169 B2 6/2010 Wassilefsky
7,761,945 B2 7/2010 Butler
7,849,544 B2 12/2010 Flocard et al.
7,886,386 B2 2/2011 Balonick et al.
8,037,564 B2 10/2011 Satoh et al.
8,104,126 B2 1/2012 Caminade et al.
8,108,957 B2 2/2012 Richards et al.
8,122,545 B2 2/2012 Wilkinson
8,146,191 B2 4/2012 Bobey et al.
8,205,282 B2 * 6/2012 Brogan et al. ..... 5/636
8,510,884 B2 * 8/2013 Lee ..... 5/655.3
2002/0116766 A1 * 8/2002 Stolpmann ..... 5/710
2002/0124319 A1 9/2002 Giori et al.
2002/0133879 A1 * 9/2002 Smith et al. ..... 5/413 R
2002/0138911 A1 10/2002 Giori et al.
2003/0009830 A1 1/2003 Giori et al.
2003/0009831 A1 * 1/2003 Giori et al. ..... 5/709
2003/0163874 A1 9/2003 Boso et al.
2003/0217414 A1 * 11/2003 Marson ..... 5/709
2003/0229943 A1 * 12/2003 Lewis ..... 5/716
2004/0000011 A1 1/2004 Hsu
2004/0163178 A1 * 8/2004 Corneil ..... 5/652
2004/0168256 A1 * 9/2004 Chaffee ..... 5/713
2005/0125905 A1 * 6/2005 Wilkinson ..... 5/713
2005/0172412 A1 * 8/2005 Pearson ..... 5/659
2005/0257320 A1 11/2005 Mollett
2005/0278852 A1 12/2005 Wahrmund et al.
2006/0005314 A1 1/2006 Lee
2006/0031996 A1 2/2006 Rawls-Meehan
2006/0040803 A1 * 2/2006 Perez, Jr. ..... 482/112
2006/0064819 A1 3/2006 Mollett
2006/0075569 A1 4/2006 Giori et al.
2006/0101743 A1 5/2006 Nickerson et al.
2006/0162779 A1 7/2006 Chaffee
2006/0179577 A1 * 8/2006 Chaffee ..... 5/706
2006/0253993 A1 11/2006 Lau
2007/0056111 A1 * 3/2007 Lastman ..... 5/655
2007/0251165 A1 11/2007 Kern et al.
2008/0028534 A1 * 2/2008 Wilkinson ..... 5/713
2008/0060138 A1 3/2008 Price et al.
2008/0235877 A1 10/2008 Murray et al.
2008/0263772 A1 10/2008 Chiu
2009/0032126 A1 2/2009 Kissel, Jr.
2009/0070941 A1 3/2009 Lau
2009/0235460 A1 9/2009 Hitch et al.
2009/0300846 A1 12/2009 Chaffee
2010/0071135 A1 3/2010 Hsu
2010/0089458 A1 4/2010 Chaffee
2010/0125951 A1 5/2010 Stefano et al.
2010/0180384 A1 7/2010 Balonick et al.
2010/0199434 A1 8/2010 Keesaer et al.
2012/0011656 A1 1/2012 Daly
2012/0011657 A1 1/2012 Kovacs et al.
2012/0036642 A1 * 2/2012 Brogan et al. ..... 5/644
2012/0090698 A1 4/2012 Giori et al.
2013/0000048 A1 1/2013 Lipman et al.
2013/0019409 A1 1/2013 Blazar et al.
2014/0082846 A1 * 3/2014 Blazar ..... 5/645

* cited by examiner

COMFORT CUSTOMIZABLE PILLOW

CROSS-REFERENCE TO RELATED APPLICATIONS

This application is related to and claims priority under 35 USC §119 to U.S. Provisional Patent Application No. 61/509,377, filed Jul. 19, 2011 and entitled "Pillow", which is hereby fully incorporated by reference herein as if reproduced in its entirety.

STATEMENT REGARDING FEDERALLY SPONSORED RESEARCH OR DEVELOPMENT

Not applicable.

REFERENCE TO A MICROFICHE APPENDIX

Not applicable.

FIELD

Embodiments may relate generally to pillow and/or other cushioned support devices, and more specifically to improved versions of such devices that allow a user to customize the comfort level and/or thickness to individual preference.

BACKGROUND

It seems that everyone has their own specific preference for desirable pillow characteristics to aid in a good night's sleep. While some people may prefer a firmer pillow, others may prefer a softer pillow; some may prefer a thicker pillow, while others may prefer a thinner or flatter pillow. Indeed, often a specific person's pillow preferences will differ depending on the position in which they are sleeping at any particular moment (since for example, a stomach sleeping position might typically be more comfortable with a thinner pillow, a back sleeping position might typically be more comfortable with some intermediate thickness pillow, and a side sleeping position might typically be more comfortable with a thicker pillow (allowing the pillow to better match the user's specific need based on the user's body contours in a particular sleeping position for example)). So a person's pillow preference might even change throughout the night as they change sleep positions. Applicants have thus designed an improved pillow to allow for personalized customization of pillow preferences by end-users, typically during usage of the pillow.

SUMMARY

Aspects of the disclosure may include embodiments of a pillow (or other cushioned support device) comprising: an outer casing; and a self-inflating inner core located within the outer casing; wherein the inner core further comprises an air impermeable cover enclosing resilient open cell foam and a (rigid) housing having a passage therethrough and an inner end contacting the foam within the impermeable cover with curvature matching the contacted foam; and wherein the inner core is in fluid communication with an external environment beyond the outer casing through the housing. In some embodiments, the inner core might typically not be in fluid communication with a pump (for example, no pump would be used in conjunction with the pillow; rather the pillow might rely on the self-inflation properties of the inner core). In some embodiments, the inner end of the housing may further comprise a center and two lateral edges, and the inner end of the housing may have a thickness profile that thins while widening from the center towards the edges. Embodiments of the housing might further comprise an outer end outside the impermeable cover, wherein the passage through the housing comprises a core opening in the inner end and a conduit opening in the outer end, and wherein the core opening has a surface area greater than that of the conduit opening. In some embodiments, the housing may be located in a corner of the inner core.

Some embodiments might further comprise a fluid conduit, having an inner end and an outer end, and a valve; wherein the valve is in fluid communication with the outer end of the fluid conduit, wherein the inner end of the fluid conduit is in fluid communication with the passage through the housing, and wherein the valve is located with respect to the outer casing to provide fluid communication between the inner core and the external environment. In some embodiments, the valve may be a two-way valve, and in some embodiments the valve might be a tap valve. Embodiments might further comprise a top surface, a bottom surface, and a comfort layer of comfort material located between the inner core and at least one surface (i.e. either the top surface or the bottom surface) of the outer casing. In some embodiments, the comfort material might comprise visco-elastic foam, down (such as goose down), hair (such as horse hair), lambs wool, and/or man-made fiberfill (for example polyester fibers and/or memory fiber). In some embodiments, the pillow might further comprise a comfort chamber associated with at least one surface of the pillow and containing the comfort material, wherein the comfort, chamber might comprise a retaining sheet. The comfort layer of embodiments may have an uncompressed IFD of about 9-12, and/or the resilient open cell foam of the inner core may have a density of about 1.8-2.2 pounds per cubic foot and/or an uncompressed IFD of about 16-20. In some embodiments, the outer casing might further comprise a pocket and a valve opening, with the valve protruding out of the valve opening and contained within the pocket. In some embodiments, the impermeable cover may be bonded or fused to the exterior of the resilient open cell foam of the inner core.

Other aspects of the disclosure might include embodiments of a pillow comprising: an outer casing; a self-inflating inner core located within the outer casing; wherein the inner core further comprises an air impermeable cover enclosing resilient material forming a matrix operable to contain a fluid; wherein the inner core is in fluid communication with an external environment beyond the outer casing through a valve; and wherein the outer casing comprises a pocket enclosing the valve. In some embodiments, the resilient material forming a matrix operable to contain a fluid may comprise resilient open cell foam. The valve of some embodiments may comprise a rubberized, cushioned, and/or padded surface. And in some embodiments, the outer casing further may comprise a valve opening through which the valve protrudes, with the valve opening located within the pocket. In some embodiments, the inner core might typically not be in fluid communication with a pump (for example, no pump would be used in conjunction with the pillow; rather the pillow might rely on the self-inflation properties of the inner core).

Other aspects of the disclosure might include embodiments of a pillow comprising: an outer casing having a top surface and a bottom surface; a self-inflating inner core located within the outer casing; and a comfort layer of comfort material located between the inner core and at least one surface (i.e. either the top surface or the bottom surface) of the outer casing; wherein the inner core further comprises an air impermeable cover enclosing resilient open cell foam; and wherein the inner core is in fluid communication with an external environment beyond the outer casing. In some embodiments, the comfort material might comprise visco-elastic foam (for example memory foam), down (such as goose down), hair (such as horse hair), lambs wool, and/or manmade fiberfill (for example polyester fibers and/or memory fiber). Some embodiments might further comprise at least one comfort chamber associated with at least one surface of the outer casing and containing comfort material. Some embodiments, in fact, may comprise two comfort chambers containing the comfort material, wherein the top surface of the outer casing comprises four sides and the bottom surface of the outer casing comprises four sides, wherein the two comfort chambers comprise a top comfort chamber associated with the top surface of the outer casing and a bottom comfort chamber associated with the bottom surface of the outer casing, wherein each comfort chamber comprises a retaining sheet (which might typically be formed of knit polyester, possibly having circular yarn) having four side, wherein the four sides of the retaining sheet of the top comfort chamber are attached to the corresponding four sides of the top surface of the outer casing, and wherein the four sides of the retaining sheet of the bottom comfort chamber are attached to the corresponding four sides of the bottom surface of the outer casing. In some embodiments, the comfort layer may have an uncompressed IFD of about 9-12, and the resilient open cell foam of the inner core may have a density of about 1.8-2.2 pounds per cubic foot and/or an uncompressed IFD of about 16-20. The comfort chamber(s) of some embodiments may have a thickness of about 3-3.5 inches. In some embodiments, each comfort chamber of a standard sized pillow might comprise specific fill weights, with about 5.5 ounces of down comfort material or about 8 ounces of fiber comfort material per comfort chamber. In some embodiments, the inner core might typically not be in fluid communication with a pump (for example, no pump would be used in conjunction with the pillow; rather the pillow might rely on the self-inflation properties of the inner core). In some embodiments, the impermeable cover may be bonded or fused to the resilient open cell foam of the inner core. For example, in some embodiments, the impermeable cover of the inner core may comprise urethane film, while the resilient open cell foam may comprise polyurethane (which in some embodiments might include a latex component); the urethane film of such an impermeable cover might be bonded to the polyurethane foam of such a resilient open cell foam during formation of the inner core. These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
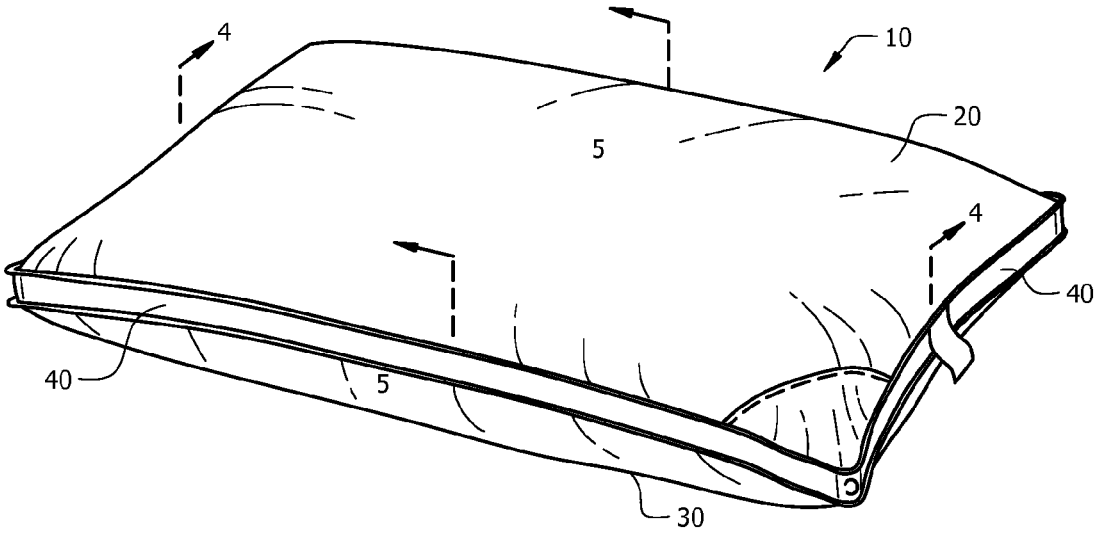
FIG. 1 is a perspective view illustrating an exemplary embodiment of customizable pillow.

It should be understood at the outset that although illustrative implementations of one or more embodiments are illustrated below, the disclosed systems, devices, and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

The following brief definition of terms shall apply throughout the application:

The term "comprising" means including but not limited to, and should be interpreted in the manner it is typically used in the patent context;

The phrases "in one embodiment," "according to one embodiment," and the like generally mean that the particular feature, structure, or characteristic following the phrase may be included in at least one embodiment of the present invention, and may be included in more than one embodiment of the present invention (importantly, such phrases do not necessarily refer to the same embodiment);

If the specification describes something as "exemplary" or an "example," it should be understood that refers to a non-exclusive example;

The terms "about" or approximately" or the like, when used with a number, may mean that specific number, or alternatively, a range in proximity to the specific number, as understood by persons of skill in the art field; and If the specification states a component or feature "may," "can," "could," "should," "would," "preferably," "possibly," "typically," "optionally," "for example," "often," or "might" (or other such language) be included or have a characteristic, that particular component or feature is not required to be included or to have the characteristic. Such component or feature may be optionally included in some embodiments, or it may be excluded.

Embodiments relate generally to pillows (or other cushioned support devices) which enable the user to customize the firmness/softness and/or thickness of the pillow based on personal preference. While the embodiments described below may discuss pillows, it should be understood that use of the term "pillow" herein is merely exemplary and not limiting, and that embodiments may also relate to other cushioned support devices (such as mattresses (or elements within a mattress) and/or mattress toppers, for example), as well. Furthermore, while the pillow examples herein may generally be discussed in the sleeping context (for example, pillows for use supporting a user's head while in bed), pillows may have other uses (for example, seating cushions or lumbar support cushions), all of which are within the scope of this disclosure.

The disclosed pillow embodiments generally may comprise an inner core within an outer casing. The inner core typically may comprise resilient material (such as open cell foam, for example) forming a matrix capable of containing fluid and located within a fluid impermeable cover. Typically, the fluid impermeable cover of the inner core would include only a single opening (with the remainder of the impermeable cover being sealed tight), and that opening would be in fluid communication with the outside environment beyond the outer casing. For example, the opening in the impermeable cover of the inner core might be connected (typically with sealing attachment to prevent leakage) to a fluid conduit with a valve that extends out of the outer casing (so that the inner core may be in fluid communication with the outside environment beyond the outer casing). The valve may typically be a two-way valve. When the valve is open and no force is applied to the core, the core may self-inflate to its maximum firmness and/or height (since the resilient open cell foam cellular structure (matrix) seeks to have fluid within the open cells to reach an equilibrium state with the external environment). If force is applied to the inner core while the valve is open, however, the fluid retained within the resilient open cell foam cellular structure (matrix) tends to be displaced and evacuated from the inner core (through the conduit and the valve into the external environment outside of the outer casing, for example); as a result, the core typically may become less firm and/or less thick, resulting in the pillow as a whole becoming less firm and/or thick. If the valve is then closed (before the resilient open cell foam is able to self-inflate back to its standard state), the lower level of firmness and/or thickness can be fixed (with the core then acting to evenly distribute the remaining fluid throughout the foam cellular structure). If the valve is then re-opened (without application of force/pressure on the pillow), the inner core may tend to self-inflate back towards its standard state (i.e. the pillow will become more firm and/or thicker, and if the valve is not re-shut before full self-inflation is complete, the pillow may tend to return to its standard equilibrium state of maximum self-inflation firmness and/or thickness). In this way, a user may adjust the firmness (and thereby comfort) and/or thickness of the pillow based on personal preference (providing a personalized level of support, comfort, and/or thickness). Indeed, the user's personal preference can easily be adjusted at the time of use of the pillow, allowing for different users (at different times) to set the pillow to their specific personal preference, or allowing a single user to readjust the pillow preference during use (if for example, the user's preference changes during usage—one example of this might be if the user changes sleeping positions and thus desires a different level of firmness and/or thickness). And because the core is self-inflating, pillow preference adjustment may occur without the use of an external pump (i.e. merely based on the self-inflating properties of the inner core and/or application of external pressure/force for deflation). In other embodiments, a pump might also be used optionally, for example to speed fluid transfer, to allow additional inflation of the inner core beyond the self-inflation maximum, to allow adjustment without application of force/pressure, and/or to allow more precise control over fluid transfer, etc.

In some embodiments, there may be one or more comfort layer(s) of comfort material(s) located between at least one surface of the core and the surrounding outer casing. The comfort layer may offer a consistent level of support and/or comfort, and may aid in more evenly distributing three (from the user's head for example) throughout the pillow. Typically, the comfort layer may be less firm than the inner core, and may be sufficiently thick so that user's may not feel the inner core within the pillow (to minimize comfort issues that might arise from using a firm inner core). In some embodiments, the comfort layer may be further enclosed within the outer casing, typically within one or more comfort chambers (typically located between the core and the outer casing). The use of comfort chambers may help retain fairly even distribution of the comfort material and/or help hold the comfort material in place, preventing uneven distribution of the comfort material in a way that could cause lumpiness in the pillow and/or uneven distribution of forces throughout the pillow.

Additionally, embodiments may include one or more features designed to address comfort concerns that might arise from the presence of the valve. For example, in some embodiments the outer casing might include a pocket that covers the valve. In some embodiments, the valve may have a rubberized, cushioned, or padded surface. In some embodiments, the valve might be inset within the comfort layer so that its outer tip might be approximately flush with (or only slightly protrude from) the pillow's outer casing. And in some embodiments, the valve might be a tap valve with a low profile surface. Persons of skill will understand these and other such comfort features for minimizing the impact of the valve on comfort while a user sleeps on the pillow.

Also, some embodiments may include a housing at the interface between the core and the fluid conduit, to enable the conduit to better function. The housing might typically be fairly rigid (typically sufficiently rigid to resist vacuum suction forces during self-inflation), and might also be shaped to match the curvature of the foam of the core to provide a snug fit. Additionally, in some embodiments the housing might widen from the conduit interface towards the foam interface, further distributing any vacuum suction forces to minimize their impact. Without such a housing, the material of the fluid impermeable cover at the interface with the conduit might neck-down under vacuum (for example, when the core is attempting to self-inflate) limiting and/or preventing self-inflation of the core and thus reducing the effectiveness of the pillow.

Figure 2:
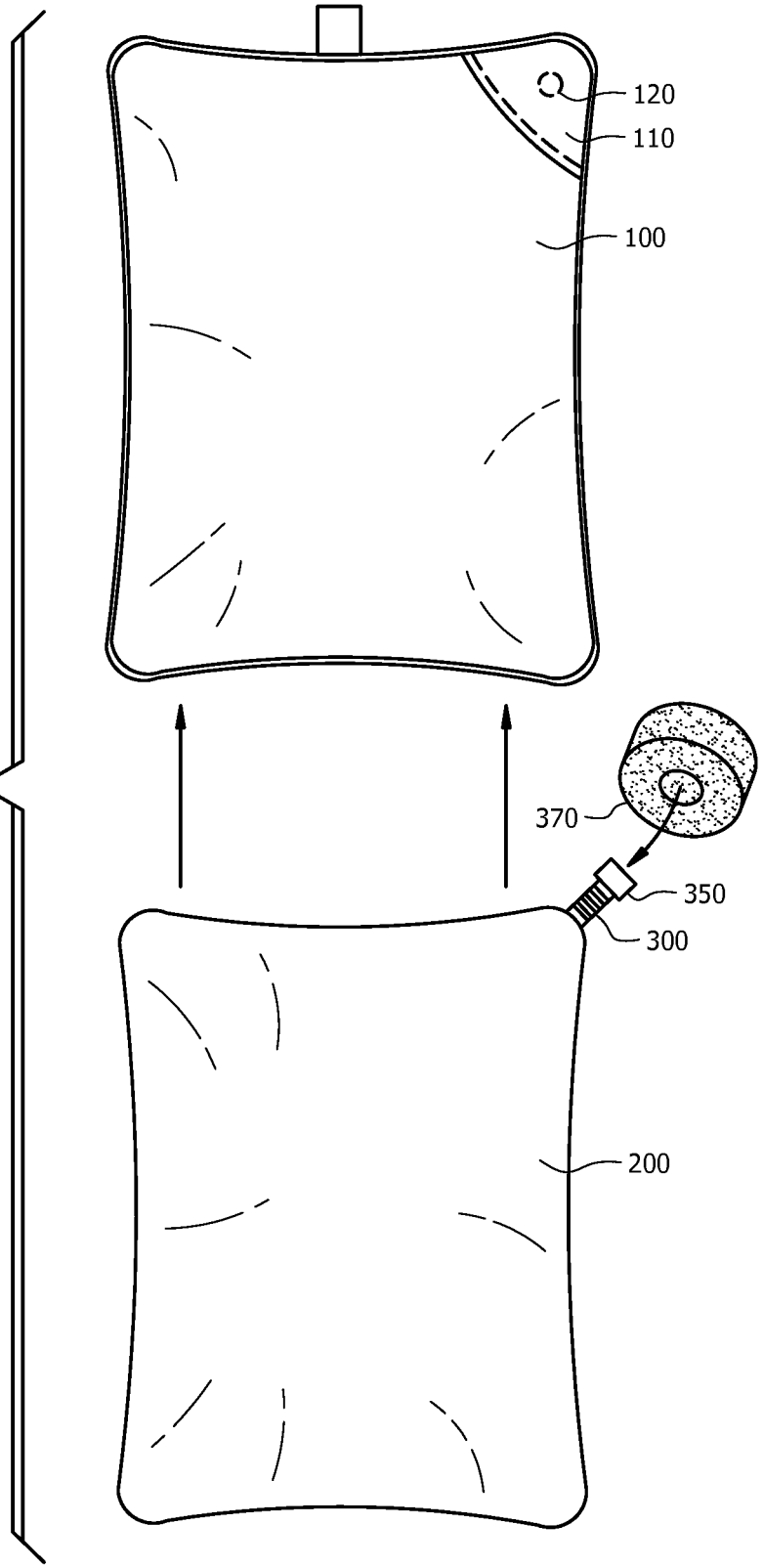
FIG. 2 is an exploded view of the embodiment of FIG. 1, illustrating an inner core within an outer casing.

While persons of skill will understand that there are many embodiments and variations of such a pillow, the following specific embodiment(s) will be discussed to provide exemplary details. FIG. 1 illustrates an exemplary embodiment of a pillow 10. FIG. 2 illustrates the pillow embodiment in exploded view, showing an outer casing 100 and an inner core 200. The outer casing 100 of FIG. 2 typically encompasses (surrounds) the inner core 200, such that the inner core 200 is entirely located within the outer casing 100. Typically, the inner core 200 of the embodiment of FIG. 2 may be approximately centered within the outer casing 100. In FIG. 2, the inner core 200 is regularly shaped, having a shape that approximates that of the outer casing 100 (although smaller in size so that the inner core 200 can fit within the casing 100); for example, in the embodiment of FIG. 2, the inner core 200 and the outer casing 100 are both rectangular in shape, in other embodiments, however, the inner core 200 could have a shape different than that of the outer casing 100. In some embodiments, the outer casing 100 may have a rectangular, square, oval, or circular shape, while the inner core 200 might have an irregular shape. For example, the inner core 200 in some embodiments might include a bulging neck roll on one or more ends and/or sides. In other embodiments, the outer casing 100 and the inner core might both have matching shapes, and the shapes could be irregular. Thus, embodiments are not limited to the specific shapes shown in FIG. 2.

The exterior surface of the outer casing 100 is typically made of a flexible fabric material. The fabric material of the outer casing 100 typically might be selected based on conformity with respect to any comfort material (that might be located between the inner core and the outer casing) and/or the need to securely retain any loose comfort fill material (to prevent possible leeching of that comfort material through the outer casing). So for example, the outer casing 100 might be formed of a knit material such as 100% polyester knit (or in other embodiments, a polyester-cotton blend knit, typically primarily polyester), for example if the comfort material is foam. Alternatively, the outer casing 100 might be formed of a woven material such as 100% cotton woven for in other embodiments, a polyester-cotton blend, typically primarily cotton), for example if the comfort material is loose fill (such as fiber fill, hair, or down for example). Knit material may tend to have preferred conformity (feel) characteristics, while woven material may tend to have a good balance of conformity and ability to prevent leeching. Alternatively, leeching concerns might be addressed with a chemical coating (typically located on the inside surface of the outer casing) in some embodiments. In some embodiments, the outer casing 100 might optionally include wicking material to aid in user comfort. In some embodiments, the outer casing 100 may comprise one or more quilted surfaces.

The outer casing of some embodiments might have a box construction (as shown in FIG. 1), having a top surface 20, a bottom surface 30, and side surfaces 40 (typically with four sides for a rectangular or square pillow, for example), with the top and/or bottom surfaces typically being the larger surfaces and serving as the sleeping surface(s) (on which the user's head might rest for example). And in some embodiments, the outer casing 100 might include rolled edges at the interface between the top/bottom surface(s) and the sides (but typically not between the various sides, see for example FIG. 1). The outer casing 100 also typically comprises a valve (or conduit) opening 120, allowing for penetration of the outer casing 100 by a valve for adjusting fluid flow into and/or out of the inner core 200, as discussed in more detail below.

While not required in some embodiments, the outer casing 100 of the embodiment of FIG. 2 also comprises a pocket 110, and within the pocket 110 may be the valve opening 120 (through which the valve for adjusting air flow into the inner core may protrude and/or be accessed). The pocket 110 of FIG. 2 is shaped to conceal and/or cover the valve while also allowing access to the valve. While a variety of shapes could be used, in the embodiment of FIG. 1 the pocket 110 is approximately triangular in shape, typically spanning one corner of a surface of the pillow outer casing 100. Typically, the pocket 110 would be formed of the same material as the outer casing 100, although in other embodiments the pocket 110 could be formed of a different material than the remainder of the outer casing 100. For example, the pocket 110 of some embodiments might be formed of a material that provides more cushioning, such as a quilted fabric material, and/or the pocket 110 could include a cushioning insert (such as a thin layer of foam or a gel insert, by way of example). And in some embodiments, the opening to the pocket 110 might include an affixing element such as hook-and-loop material, a snap, or a button (but the embodiment of FIG. 2 does not include such an optional feature—rather the material of the pocket of FIG. 2 may fit sufficiently tightly to the surface of the outer casing 100 of the pillow to prevent excess gaping while allowing ready access to the valve).

Figure 4:
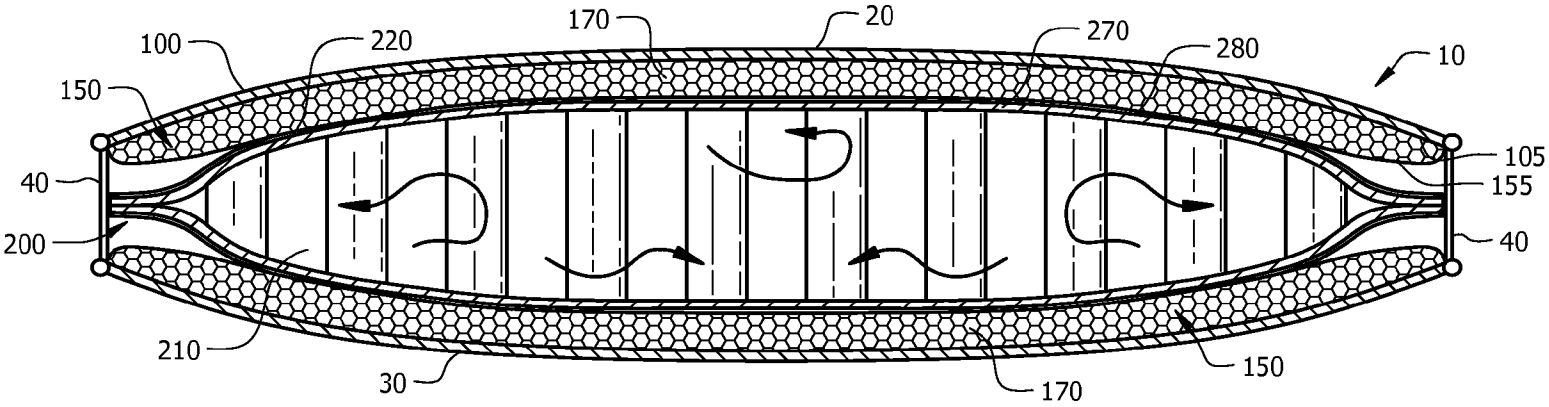
FIGS. 4 and 5 are cross-sectional images of the embodiment of FIG. 1.
Figure 5:
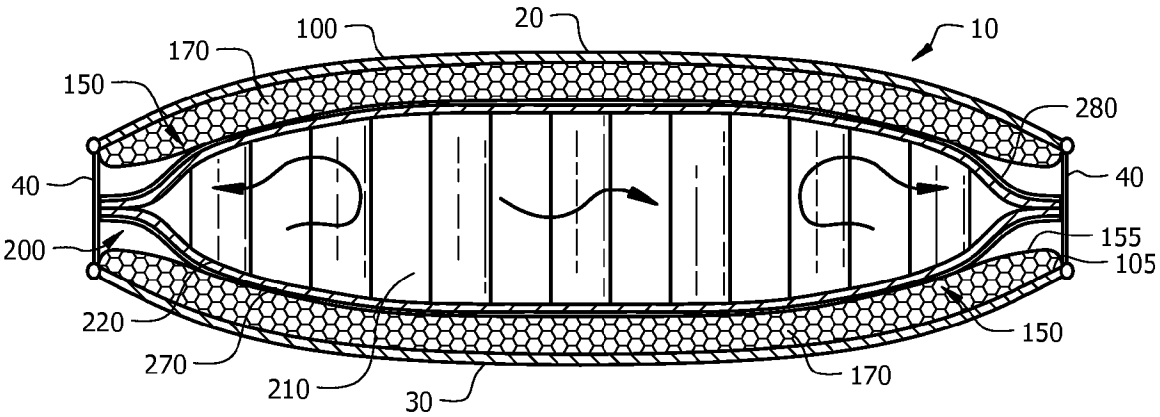

The inner core 200 of FIG. 2 may comprise a fluid impermeable cover 220 with resilient filling material therein forming a matrix or other such structure capable of containing a fluid (see FIGS. 4 and 5 for example, showing cross-sections of the pillow embodiment of FIG. 1). While pillow(s) might be designed to operate with many different fluids (including various liquids or gases), typically the fluid in the embodiment of FIG. 4 might be air. Thus, the fluid impermeable cover 220 might be air impermeable (airtight), and the resilient material matrix/structure might contain air (in its uncompressed state). The use of air as the fluid for inflation of the pillow may allow for simpler use, since the fluid conduit and valve may simply interact with the external air atmosphere during deflation and/or self-inflation of the inner core 200. The impermeable cover 220 of FIG. 4 might, for example, be formed of a polyurethane film, such as vinyl. Typically, the thickness of the film of the impermeable cover 220 might be at least sufficient to functionally work to durably seal the core, but the thickness typically may not exceed the amount that might impact the feel of the inner core. For example, in the embodiment of FIG. 4, the polyurethane film typically might have a thickness of about 3-7 mils (for example about 5 mils in the embodiment of FIG. 2).

The resilient material within the inner core of FIG. 4 typically comprises resilient open cell foam 210 (with the open cell nature of the foam forming the matrix/structure for retaining air). For example, the resilient material could comprise an open cell foam rubber, such as polyurethane foam for example. In some embodiments, the polyurethane foam of the inner core might also include a latex component. Typically, the resilient open cell foam 210 and the impermeable cover 220 might be formed of compatible materials, allowing the impermeable cover 220 to be bonded, welded, and/or fused to the resilient open cell foam 210. Bonding the impermeable cover 220 to the resilient open cell foam 210 may provide a more comfortable pillow by preventing or minimizing any ballooning effect in the inner core 200 (which for example might cause a user to feel as if the inner core were rolling when the user moved). In other words, bonding the impermeable cover to the resilient open cell foam may result in the inner core acting as a single unit to provide more consistent support. Typically a continuous block of such foam might be used in the embodiment of FIG. 4. In FIG. 4, the resilient open cell foam 210 of the inner core typically might have an Indentation Force Deflection (IFD) range between about 16-20, and/or a density ranging between about 1.8-2.2 pounds per cubic foot. And in some embodiments, the resilient open cell foam 210 might have airflow characteristic of at least about 2.5 ASTM Standard Measurement (for example, cubic feet per minute for test performed according to standard). Alternatively, in some embodiments it might be possible for the resilient material to comprise resilient material in loose form, providing a matrix/structure, of air pockets between and/or around the loose resilient material. For example, in some embodiments, the resilient material might be foam bits, batting, or fiberfill, for example.

Typically, the resilient material (such as resilient open cell foam 210) of the inner core 200 may have a high level of homogeneity, both in a compressed and a fully expanded state. The high level of homogeneity may allow the pillow 10 to assume relatively flat top 20 and bottom 30 surfaces, which may contribute to comfort. Furthermore, the homogeneous nature of the resilient filling material may provide more even pressure on the user's head, for example, typically with less sag in the center of the pillow 10. Additionally, the homogeneous nature of the resilient filing material may provide for better distribution of fluid (typically air) throughout the matrix/structure, so that localized pressures experienced by the pillow may be quickly equalized. Thus, the highly homogenous resilient filling material may allow the pillow 10 to operate better as the internal pressure within the inner core is changing (for example during inflation and/or deflation). In some embodiments, the resilient open cell loam 210 of the inner core of FIG. 4 might optionally be formed using variable pressure foaming (VPF) process of foam formation, since this process may assist in creating very regular cellular structure (which could improve homogeneity).

Figure 3:
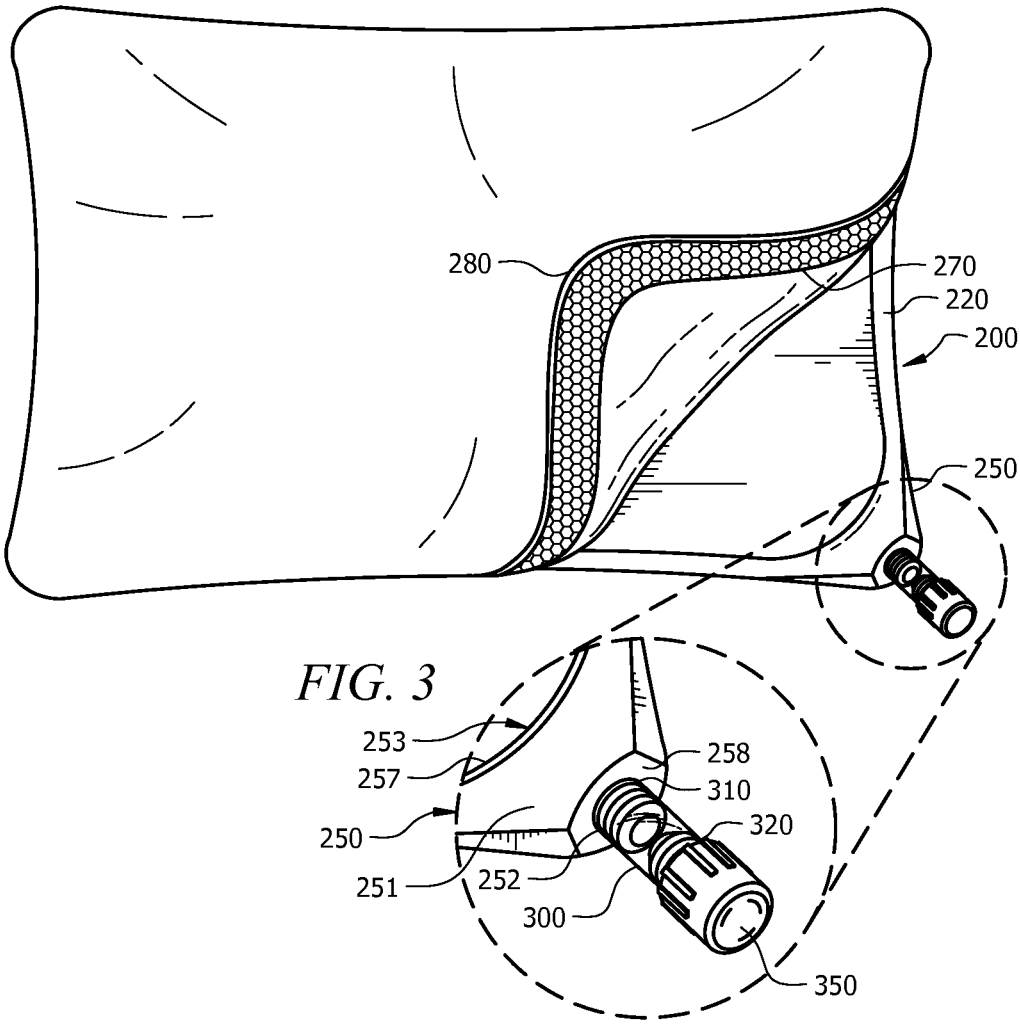
FIG. 3 illustrates an exemplary inner core, peeling back optional encasement layers for illustration purposes.
Figure 6:
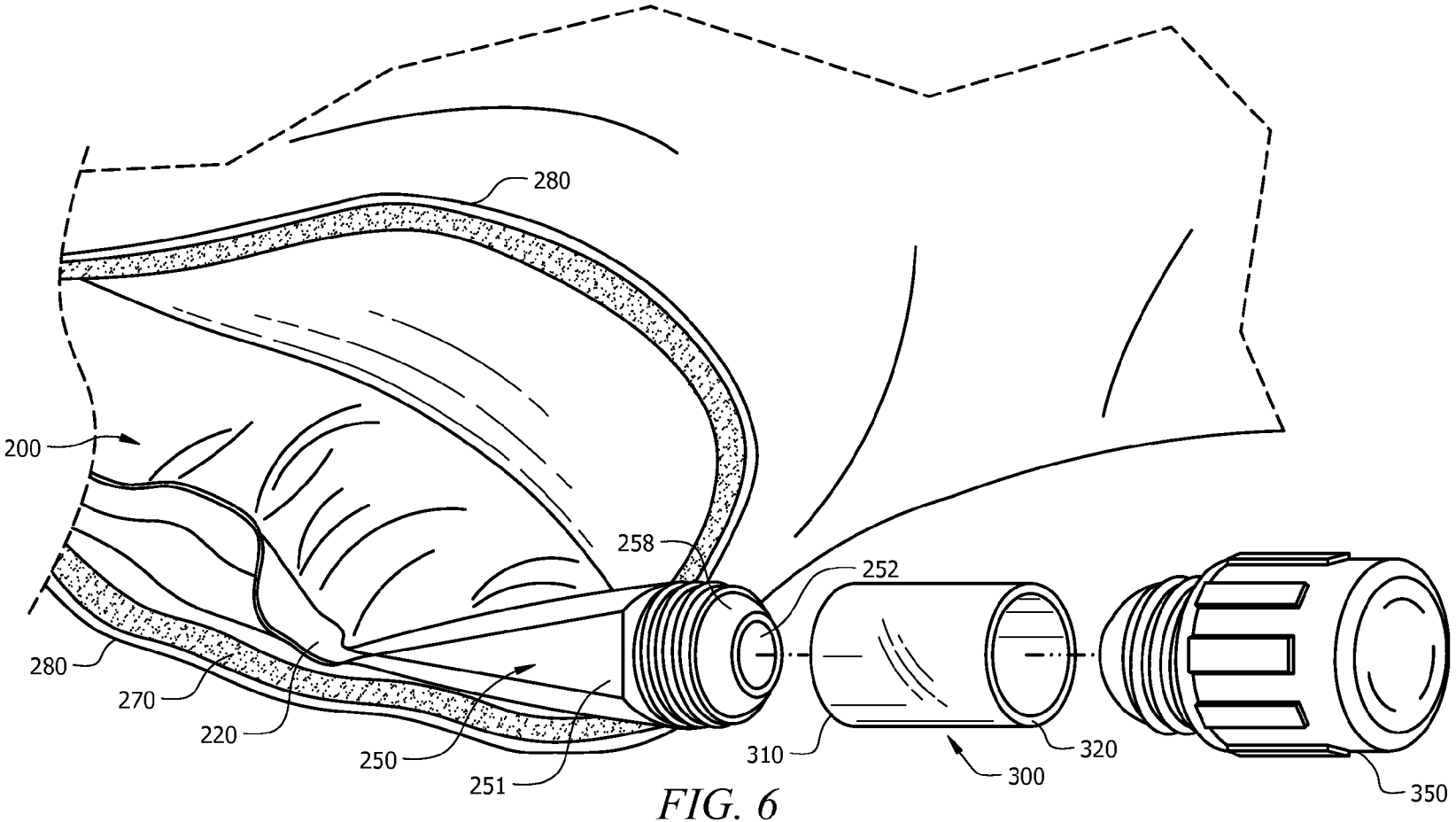
FIG. 6 is an enlarged image of the housing, fluid conduit, and valve for an exemplary inner core.

The resilient open cell foam 210 of the inner core 200 of FIG. 4 is typically sealed within the impermeable cover 220, such that air transfer into and/or out of the core is through one or more openings 225 in the impermeable cover 220. In some embodiments, the impermeable cover might be fused or bonded to the outer surface of the resilient open cell foam. In FIG. 2, the impermeable cover 220 might contain only a single opening 225 (although in other embodiments, for example embodiments having more than one valve, there could be additional openings). In the embodiment of FIG. 3, the opening 225 in the impermeable cover 220 is in fluid communication with a fluid conduit 300 leading from the inner core 200 to a point beyond the outer casing 100 (such that the inner core 200 is in fluid communication with the exterior environment/atmosphere beyond the outer casing of the pillow). More specifically, the fluid conduit 300 might have an inner end 310 in fluid communication with the inner core 200, and an outer end 320 in fluid communication with the external environment/atmosphere beyond the outer casing 100 (see FIG. 6 for example). The fluid conduit 300 of FIG. 6 may typically be formed of material that is sufficiently rigid to resist necking down under the suction force involved with self-inflation of the core 200. In the embodiment of FIG. 6, however, the material of the fluid conduit is not too hard or rigid, since excess rigidity/hardness might compromise comfort and/or make positioning of the outer end 320 of the conduit with respect to the valve opening 120 of the outer casing difficult. Additionally, white the fluid conduit 300 typically might have a diameter sufficient to provide for adequate airflow into and out of the inner core 200, the fluid conduit also typically may minimize the diameter to minimize its comfort impact on the pillow. And while flexibility may be useful to some degree, the fluid conduit may also typically be formed to minimize the possibility of crimping. The fluid conduit 300 of FIG. 2 might be formed of urethane tubing, for example.

In the embodiment of FIG. 6, the outer end 320 of the fluid conduit 300 would typically (sealingly) connect to a valve 350. The valve 350 of FIG. 6 typically may comprise a two-way valve, such that when the valve 350 is open and there is no pressure on the inner core, the valve may allow air to enter the inner core 200 via self-inflation, but when the valve 350 is open and pressure is applied to the inner core, air might be operable to exit the inner core 200 through the fluid conduit 300 and the valve 350 (deflating the core). Examples of such valves might include a twist valve (as shown in FIG. 3 for example), pushbutton or tap valve, or a valve with a switch mechanism. Typically, if a twist valve is used, it might include a positive stop (and in some embodiments it might include set click-through positions, allowing a user to control the rate of fluid flow (i.e. the amount the valve is open) based on the number of clicks). Alternatively, the valve 350 might comprise a tap valve. Typically, a tap valve might comprise a housing (typically with an opening in at least the outer end), a seal element (for example a sealing ring, a button shaped to interface with the housing and the seal (so that when the button is pressed, it moves away from the seal and the opening in the outer end of the housing to allow air flow into or out of the valve), and a spring or other biasing member (typically oriented so that it biases the button into a closed (sealed) position. Often, the housing might optionally have a bottom cap that might interface with the spring (providing resistance for the spring to push off of), and typically the bottom cap may have one or more openings allowing airflow into the fluid conduit and/or inner core. Such a tap valve would typically be closed/sealed unless a user pressed the button to open the valve. Typically, such a tap valve might be mounted so that its outer surface is approximately flush with the outer casing.

Figure 7:
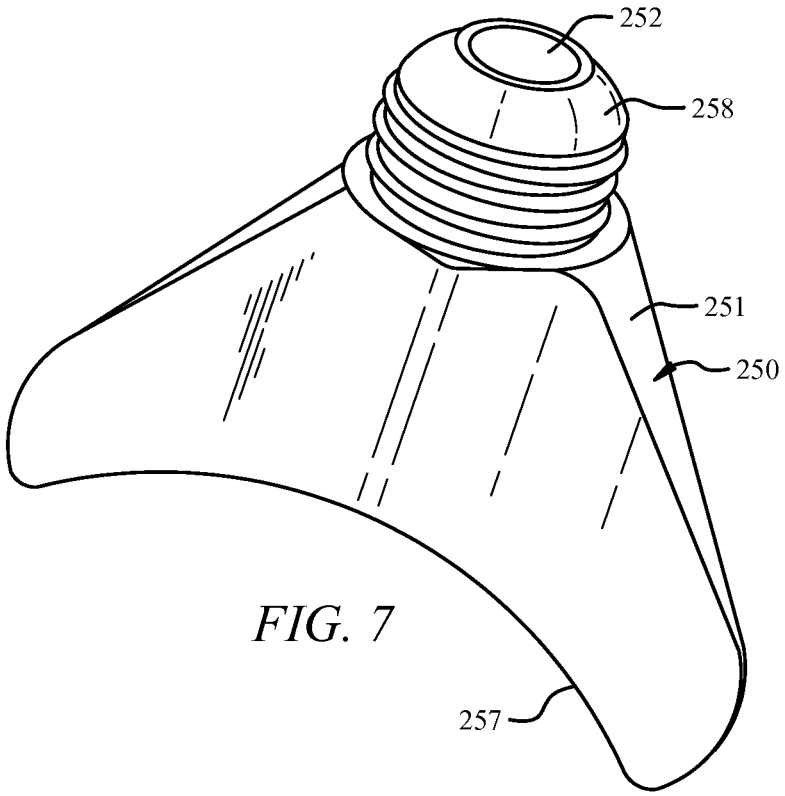
FIGS. 7-8 are perspective views of an exemplary housing.

In the embodiment of FIG. 6, the inner end 310 of the fluid conduit would typically (sealingly) connect to a housing 250 located at the opening 225 in the impermeable cover 220 and typically at least partially located within the impermeable cover 220 of the inner core. The housing 250 may enable the fluid conduit 300 to function better with respect to the self-inflating inner core 200 by, for example, minimizing the possibility that the material of the impermeable cover 220 might draw or neck down under vacuum (during self-inflation, for example) to seal or restrict airflow with respect to the inner core 200. The housing 250 of the embodiment of FIG. 6 typically comprises a hollow body 251 (having a passage or opening therethrough) having an inner end 257 and an outer end 258 (see also FIGS. 7-8). Typically, the housing body 251 might be more rigid than the conduit. In some embodiments, the housing might be made of a rigid material. In other embodiments, the housing might be formed of a fairly flexible material, but the structure of the housing might provide rigidity. The inner end 257 of the housing typically is sealed within the impermeable cover 220, while the outer end 258 of the housing typically extends beyond the impermeable cover 220. The outer end 258 of the housing of FIG. 6 typically is sealingly connected with the inner end 310 of the fluid conduit 300 (to form an airtight connection). For example, the connection might be accomplished using one or more threaded surfaces and/or adhesive/sealant. The outer end 258 of the housing typically comprises a conduit opening 252 at the point of connection with the fluid conduit 300, while the inner end 257 of the housing typically comprises a core opening 253 (in other words, the passage through the hollow body 251 typically may have a core opening 253 in the inner end 257 of the housing and a conduit opening 252 in the outer end 258 of the housing).

Figure 8:
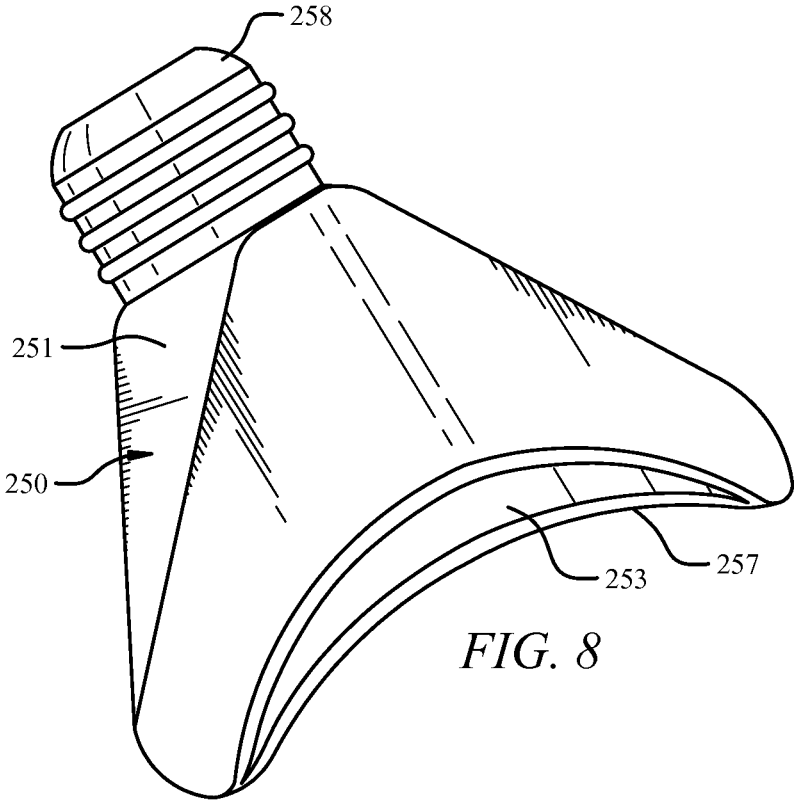

Thus, fluid communication into and out of the inner core 200 of FIG. 6 may be through the hollow housing 250 (for example, through the passage formed between the core opening 253 and the conduit opening 252). The inner end 257 of the housing of FIG. 8 may be shaped to fit snuggly against the resilient open cell foam 210 within the impermeable cover 220 of the core (allowing positive contact). For example, if the housing 250 is located in a corner of the inner core 200, the inner end 257 (and therefore typically the core opening 253) of the housing might typically be shaped to match the curvature of the resilient open cell foam 210 of the inner core. And in some embodiments, the inner end 257 might have a thinner (thickness) profile than the outer end 258 and/or the inner end 257 (and thereby the core opening 253) might have greater width than the outer end 258 of the housing (and thereby the conduit opening). In the embodiment of FIG. 8, the inner end 257 might have a thinner (thickness) profile as it widens (perhaps with the center of the inner end/core opening having thickness approximating that of the outer end/conduit opening, and the inner end/core opening thinning as it widens towards lateral edges). In some embodiments, the core opening may have surface area that is greater than the surface area of the conduit opening (for example, the core opening might be about 1.5-2 times greater than the conduit opening). Such housing 250 shape(s) may help to minimize neck-down concerns, while allowing the inner core 200 sufficient fluid communication for effective self-inflation and/or comfort adjustment. In the embodiment of FIG. 3, the housing may be located eta a corner of the inner core. In alternative embodiments, on the other hand, the inner end 310 of the fluid conduit might directly (sealingly) attach to the opening 225 of the inner core 200 (without the use of a housing, for example). Persons of skill will also understand that in other embodiments two one-way valves might be used (for example, with one valve for self-inflation and another valve for deflation), which might necessitate two conduits and/or two housings.

In operation, the valve 350, fluid conduit 300, and the housing 250 of FIG. 1 provide fluid communication between the inner core 200 and the external environment/atmosphere:

beyond the outer casing 100 and/or pillow, and thus allow for adjustment of the comfort level and/or thickness of the pillow 10. The fluid conduit 300 has sufficient length that, when used in conjunction with the valve 350 and optionally the housing 250, it may span any comfort layer(s) surrounding the inner core 200 within the outer casing 100.

In some embodiments, the pillow may have an optional comfort layer between the inner core and the outer casing. The comfort layer might typically be formed of a matrix of resilient material and fluid (typically air) in open spaces, cells, or interstices within or between the resilient material, and typically the comfort layer might interact with the exterior environment/atmosphere in a way that provides a desired level of resilience and/or support (for example by air flow through the permeable/breathable outer casing). Such a comfort layer may improve comfort properties of the pillow. For example, the comfort layer may help to distribute forces/pressure (for example, from the user's head lying in the pillow), allowing more uniform interaction with the inner core. This may help to reduce sagging and provide a flatter sleeping surface (for example the top surface of the pillow). The comfort layer may also serve to provide a buffer around the inner core, shielding the user from feeling the firmness of the inner core. The comfort layer typically may have an IFD and/or thickness sufficient to provide such a comfort buffer, while also allowing the inner core to effectively respond to the weight of a typical user's head. The comfort layer typically comprises comfort material. Examples of comfort material might include visco-elastic foam such as visco-elastic polyurethane foam (memory foam), memory fibers or other types of fiberfill, down (for example goose down), hair (such as horse hair), lamb wool, gel, etc. By way of example, if the comfort material comprises memory foam, it might have an UM of about 9-12. For loose fill materials, such as fiberfill and down, the comfort material might typically be stuffed within an enclosure to a level to function effectively. In some embodiments, the comfort material might have a thickness of about 3-3.5 inches on one or two sides of the inner core. Typically the same comfort material might be used throughout the comfort layer, but in some embodiments more than one comfort material might be used. For example, the top and bottom surfaces of the pillow could have different comfort materials associated therewith, allowing the user to alter the pillow's comfort characteristics by flipping the pillow over. In other exemplary embodiments, more than one comfort material might be mixed together and used throughout the pillow's comfort layer. In some embodiments, the comfort layer might wrap around the entire inner core or otherwise surround the inner core. For example, if a batting of comfort material is used, the batting could be wrapped around the inner core; or if foam is formed around the inner core, the core might be completely enveloped by the comfort foam. In other embodiments, however, the comfort layer might only be associated with the top and/or bottom surface(s) of the pillow.

In the embodiment of FIGS. 4-5, the pillow 10 may optionally comprise one or more comfort chambers 150 containing the comfort material 170 (in other words, the comfort layer might comprise one or more comfort chambers as well as the comfort material). In the embodiment of FIG. 4, the comfort layer comprises two comfort chambers 150 containing comfort material 170, with one comfort chamber 170 associated with the top surface 20 of the pillow and the other comfort chamber 170 associated with the bottom surface 30 of the pillow. Each of the comfort chambers 170 of FIG. 4 might typically be formed of a retaining sheet of material 155 attached to the inner surface 105 of the outer casing 100 to form a closed pocket or sheath for enclosing and retaining the comfort material 170. The retaining sheet 105 forming the inner surface of each comfort chamber 150 typically is formed of a material with fairly low coefficient of friction (to minimize the impact of friction forces on the comfort materials and/or inner core, and/or to simplify insertion of the inner core). For example, the retaining sheet 105 might be formed of knit polyester (typically with circular yarn, to provide a slick feeling surface). So in the embodiment of FIG. 4, the pillow 10 may have comfort chambers 150 associated with the top and bottom surfaces, with little or no comfort material on the sides 40 of the pillow 10. In some embodiments, this may be accomplished by having all (typically four) sides of the retaining sheet 155 for each comfort chamber affixed (typically sewn) to the corresponding (typically four) sides of the inner surface 105 of either the top or bottom of the outer casing 100 (so in FIG. 4, for example, the four sides of the top retaining sheet for the top comfort chamber may be attached to the corresponding four sides of the top inner surface of the outer casing to form the top comfort chamber between the top of the outer casing and the top retaining sheet, and the four sides of the bottom retaining sheet for the bottom comfort chamber may be attached to the corresponding four sides of the bottom inner surface of the outer casing to form the bottom comfort chamber between the bottom of the outer casing and the bottom retaining sheet). The lack of comfort material 170 on the sides 40 of the pillow 10 in the embodiment of FIG. 4 may be useful for allowing the inner core 200 to respond to pressure (for example, since there would be no external support provided by any such side comfort materials that might restrict or limit compression of the inner core 200). Additionally, the lack of comfort material 170 on the sides 40 of the pillow 10 may help to provide a flatter sleeping surface (for example on the top surface 20 of the pillow).

The comfort material 170 of FIG. 4 is typically contained in (enclosed within) the comfort chamber(s) 150 to help keep the comfort material in place, so that the distribution (for example, location and amount/density/fill weight) of comfort material 170 can be kept fairly uniform, for example preventing clumps or voids that might produce an uneven sleeping surface and/or result in uneven distribution of force/pressure to the inner core. Thus, the comfort chambers 150 may aid in ensuring a high level of homogeneity of the comfort material 170 throughout the pillow (or at least for associated surfaces of the pillow). The comfort chamber(s) may also make construction of the pillow easier, by for example simplifying insertion of the inner core and/or insertion and/or distribution of the comfort material. In alternative embodiments, multiple comfort chambers might be used for the top and/or bottom surfaces of the pillow, for example forming a series of baffle-like enclosures to further retain the distribution of comfort material 170 in place (i.e. to help even distribution of comfort material). Alternative embodiments could also have a comfort chamber for one surface (for example the top surface of the pillow), but not for the other surface, or might have comfort chambers with varying IFD, thickness, density, and/or fill weight associated with different surfaces.

In some embodiments, the thickness of each comfort chamber might be about 3.5 inches when the comfort material is foam, while the thickness of each comfort chamber might be about 3 inches for loose comfort materials (such as down or fiberfill). So for example, a standard pillow having foam comfort material might have comfort chambers that were about 10 inches by 16 inches by 3.5 inches. A standard pillow having loose comfort fill material might instead have comfort chambers of about 13 inches by 19 inches by 3 inches. The IFD of such foam comfort material might be about 9-12. For loose comfort fill material (such as down and fiberfill), the comfort chambers might be filled based on specific fill weights. So for example, a standard size pillow might have about 5.5 ounces of down per chamber, while an alternative standard size pillow might have about 8 ounces of fiberfill per chamber.

Some embodiments might also optionally include a comfort wrap 370 located about the fluid conduit 300, as shown in FIG. 2. Typically, the comfort wrap 370 would enwrap the length of the fluid conduit 300 and/or valve 350 (and/or outer end 258 of the housing) as it passes from the inner core 200, through the comfort layer, to the outer casing 100. This comfort wrap 370 may minimize comfort impact of the fluid conduit 300 passing through the comfort layer, so that the comfort layer may provide approximately uniform comfort properties. In the embodiment of FIG. 2, the comfort wrap 370 may comprise one or more cylinders of polyester fiber batting (i.e. batting having a hole therethrough to receive the conduit), for example.

Some embodiments might include an optional foam encasement and/or encasement covering surrounding the inner core. The foam encasement typically is very conforming, providing a good interface between the comfort layer and the inner core (which may improve the comfort characteristics of the pillow). In the embodiment of FIG. 6, the inner core is encased/surrounded by foam encasement layer 270. The foam encasement layer 270 of FIG. 6 may typically be formed of visco-elastic polyurethane foam (memory foam). And in FIG. 6, the foam encasement 270 and inner core 200 are contained within an encasement covering 280. The encasement covering typically reduces frictional impact during usage (which may aid in the durability of the pillow by preventing tearing of foam, for example) and/or makes insertion of the inner core easier. The foam encasement might also serve to protect the inner core from puncture. In FIG. 6, the encasement covering 280 typically might be formed of 100% polyester (typically of flat yarn). Typically, the foam encasement 270 fits snuggly against the inner core 200 (tightly enwrapping the core), and the encasement covering 280 fits snuggly around the foam encasement layer 270 (such that the inner core. 200, foam encasement 270, and encasement wrap 280 may act as a single unit that can easily be inserted into the outer casing 100, typically between the comfort chambers 150 for example).

Figure 9:
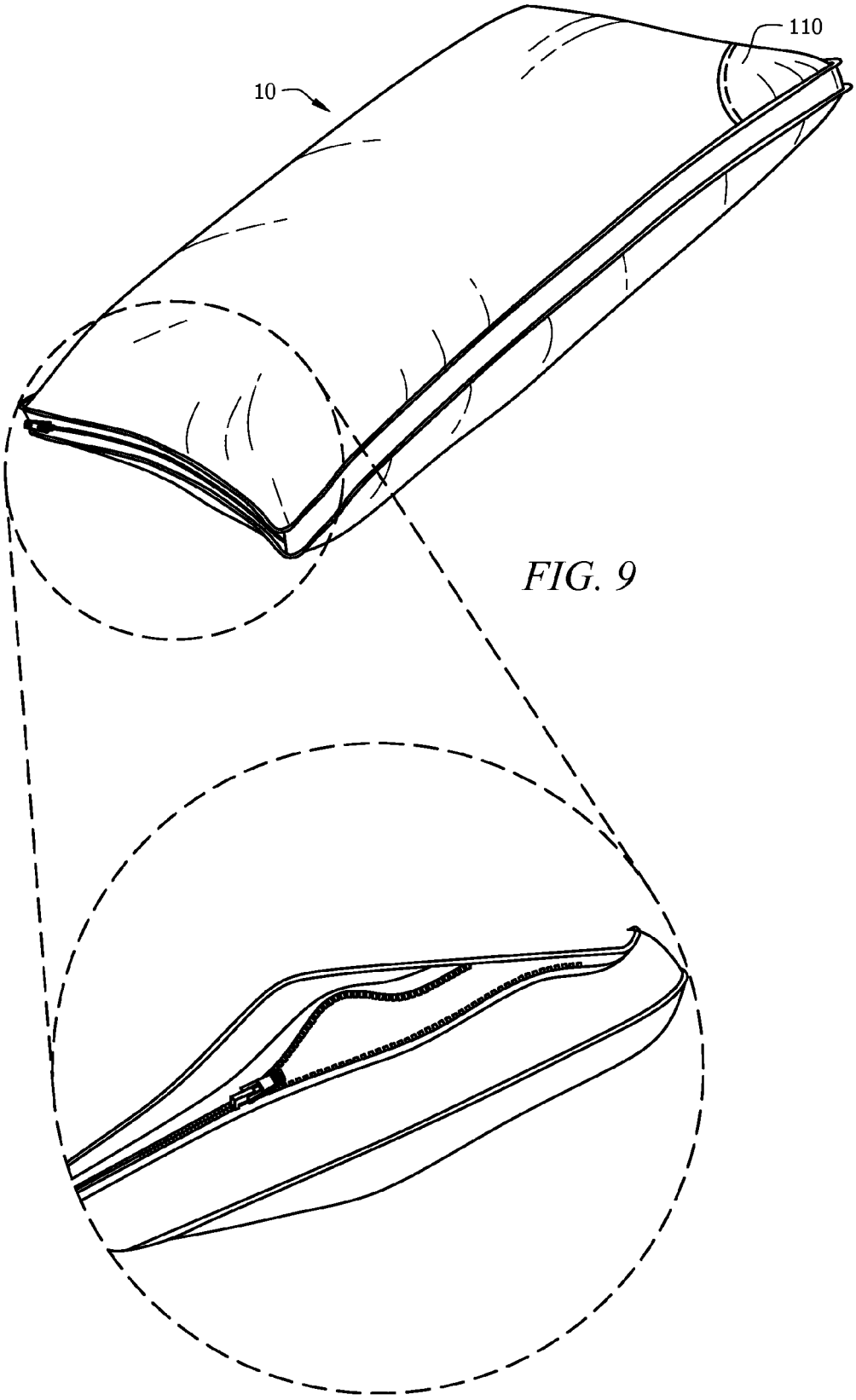
FIG. 9 illustrates an exemplary pillow, with an enlarged image of a zippered opening.

Typically, the outer casing 100 may be sewn shut once the internal elements (such as the inner core 200 and/or comfort layer(s), for example) have been inserted in place, so that the pillow 10 might provide a single sealed unit. In other embodiments, however, the outer casing 100 might include an opening (see FIG. 9 for example) that may optionally be closed shut (for example by a zipper, snap(s), hook-and-loop tape, etc.). If the outer casing includes an opening, then it may be possible in some embodiments to remove the inner core to allow for cleaning of the outer casing (for example, machine washing). The embodiment of FIG. 1, however, does not include such an opening and is not intended for removal of the inner core by the end-user (since for example, this might make the inner core more likely to be damaged, for example punctured, which would render the pillow non-adjustable). In the pillow 10 of FIG. 1, the outer casing 100 is sealed shut (typically sewn) so that the outer casing 100 and/or comfort layer may provide additional protection to the inner core 200 full-time (minimizing the chances of puncture of the impermeable cover 220 of the inner core 200).

Typically, the inner core of the pillow of FIG. 1 might take up a range of about 10-40% of the volume within the pillow (and in many embodiments the remainder of the volume within the outer casing of the pillow might comprise the comfort layer). In some embodiments, for example, the inner core might make up about 13% of the pillow volume. In other embodiments, the inner core might take up about 27-38% of the volume of the pillow, for example in some embodiments the inner core might make up about 33% of the pillow volume. Furthermore, the uncompressed (and fully inflated) thickness of the pillow of FIG. 1 might typically be in a range of about 6-8 inches, with the thickness of the fully inflated inner core typically being in the range of about 3-4 inches (such that in some embodiments the thickness of the inner core typically might be about 30-67% of the total pillow thickness); typically the remainder of the pillow thickness (other than the thickness of the inner core) might relate primarily to the thickness of the comfort layer. Also, typically the IFD of the resilient material in the inner core is greater than that of the resilient material of the comfort support layer. In embodiments, the resilient material of the comfort layer typically might be less firm than that of the inner core and sufficiently thick so that the comfort layer can provide a buffering effect (so that the user is unlikely to feel the more firm inner core). The resilient material of the comfort layer typically also may effectively pass the force of a user's head on the pillow through to the inner core (so that the inner core may respond to that force/pressure to adjust). The inner core resilient material typically may be sufficiently resilient so that it may provide effective self-inflation, while also being sufficiently soil to respond effectively to the weight of the user's head while providing support. Thus, the components of such a pillow (as shown for example in FIG. I) may be designed so that they interact effectively to respond to the weight of a typical user's head (for example about 8 pounds).

In the embodiment of FIG. 2, the self-inflating properties of the inner core 200 (typically arising from having the matrix of resilient material within an air impermeable cover in fluid communication with the external environment/atmosphere) may allow for adjustment of the pillow's support/comfort and/or thickness without the use of an external pump; specifically, the self-inflating core allows for a deflated pillow core to re-inflate without use of a pump. In alternate embodiments, however, an optional pump could also be used to assist in adjusting the pillow (in which case, the pump would typically be connected to the fluid conduit, typically either through the valve or in place of the valve). In some embodiments a pump might prove advantageous for more rapidly inflating and/or deflating the core, for adjusting the pillow with finer precision, and/or for adjusting a pillow or other comfort support unit (such as a mattress topper or mattress component) which might prove difficult to manually deflate (perhaps requiring weight and/or strength beyond that which might comfortably be applied by a user).

Embodiment methods of the disclosure may also provide for improved manufacture of such pillows. Typically, a self-inflating inner core (typically having a fluid conduit and a valve projecting out) and an outer casing might be provided. In instances in which the outer casing includes comfort chamber(s), the comfort chamber might be filled with comfort material and closed/sealed. Comfort wrap might optionally be applied around the fluid conduit extending from the inner core, and then the inner core might be inserted into the outer casing. In instances in which the comfort layer is not contained within one or more comfort chambers, comfort material might be wrapped about the core prior to its insertion into the outer casing and/or comfort material might be placed within the pillow between the inner core and the outer casing (on at least one surface, and more typically on the bottom and top surfaces). For example, loose comfort material that is not contained within a comfort chamber might be placed in the pillow between the inner core and the outer casing after insertion of the inner core within the outer casing.

In embodiments involving foam comfort material, the inner core might be placed in a mold, and foam materials (for example liquid components that react chemically to form foam) might be introduced into the mold. Typically, this might be a closed mold process (for example, the mold might be closed after introduction of the foam materials to form an enclosed cavity), and the foam comfort material would typically form around the inner core. Typically, the inner core would be held in place within the mold so that, for example, it might be located near the center of the mold so that the foam comfort layer might form around the inner core. For example, the mold might be indexed to locate the inner core and/or pins might be used to hold the inner core in place in the mold. Then the comfort-surrounded core (for example, the inner core enclosed within foam comfort material) might be removed from the mold and inserted into the outer casing. In other embodiments, the inner core might be placed in the outer casing and foam materials might be introduced within the outer casing (so the core might be surrounded by the resulting foam). The outer casing might typically have an opening during manufacture, and in some embodiments the outer casing might also typically include a valve opening sized to receive the valve. The inner core typically might be oriented so that, as it is inserted into the (opening of the) outer casing, the valve attached to the fluid conduit projecting out of the inner core might be aligned to project out of the outer casing through the valve opening, in some embodiments, the valve would then be located within a pocket on the exterior of the outer casing. And in some embodiments, the core might be optionally encased within foam encasement (or other such encasement layer) and/or enclosed within an encasement covering prior to insertion into the outer casing. Once the inner core and any comfort layer have been inserted/placed into the outer casing, the outer casing may be closed/sealed. While some embodiments might releasably close the outer casing (with a zipper, snap, hook-and-loop, etc., so that the outer casing may be easily opened and re-closed by an end-user), other embodiments might permanently close the outer casing (by sewing it shut, for example).

The inner core of some embodiments might be formed using film and foam (wherein the film typically surrounds the foam and may be bonded to the foam). In embodiments, the step of providing the inner core might comprise providing foam for the inner core (which in some instances might include cutting foam), placing a first sheet of film in a mold cavity, placing the foam atop the first sheet of film in the mold cavity, and placing a second sheet of film atop the foam in the mold cavity. Typically, the film and foam might be selected to be compatible, so that they might bond effectively when heated (for example, urethane film might be used in conjunction with polyurethane foam). Also, the film might be sized so that its periphery may extend beyond the mold cavity. The mold cavity might typically be sized and shaped to form an inner core of the desired size and shape. A housing might be placed within the mold, so that at least one end of the housing may be sealed within the film of the impermeable cover upon formation of the inner core. Typically, the housing might be placed within the mold so that the inner end of the housing may be sealed within the impermeable cover formed by the film sheets, while the outer end of the housing may be located outside of the impermeable cover of the inner core. For example, the housing might be placed in a recess in the mold, which would hold the housing in place in the mold during formation of the inner core. The mold might then be closed and heated to bond the film to the foam and/or to bond contacting periphery surfaces of the first sheet of film to contacting periphery surfaces of the second sheet of film to form a sealed edge. around the perimeter of the inner core. Excess film about the periphery of the formed inner core may be trimmed in some instances. Typically, after application of bonding heat/energy, the inner core would be sealed about its entire perimeter except for a single opening formed by having one end of the housing protruding out of the inner core beyond the film forming the impermeable cover.

In some embodiments, the mold might be closed by application of force from one or more platen (or, for example, the top portion of the mold might be clamped with a brace) and/or the bonding heat/energy might be applied via ultrasonic welding techniques (for example using radio frequency (RF). In some embodiments, formation of the foam might optionally involve VPF processing. And in some embodiments, the mold might comprise a soft silicon mold. In some embodiments, formation of the inner core might further comprise affixing a fluid conduit (typically the inner end of the fluid conduit) to the outer conduit opening of the housing (typically using adhesive and/or threads or other mechanical attachment, for example to form an airtight seal) and/or affixing a valve to the outer end of the fluid conduit (typically using adhesive and/or threads or other mechanical attachment, for example to form an airtight seal). Formation of the inner core typically results in a self-inflating core having a single pathway for controlled fluid exchange with the exterior environment/atmosphere.

In embodiments, providing an outer casing typically might comprise forming an outer casing from flexible fabric material. The formation might provide box construction, with the outer casing having a top and a bottom surface, as well as side surfaces. Typically, one side of the outer casing is left open, to allow for easy insertion of the inner core and/or comfort layer. In some embodiments, forming the outer casing might further include forming one or more comfort chambers and adding comfort material into the comfort chambers (which would then typically be sealed shut). Typically, comfort chamber(s) might be formed on the inner top and/or bottom surfaces of the outer casing. In some embodiments, each comfort chamber might be formed b attaching a retaining sheet to the inner surface of the outer casing. In some embodiments, a valve opening might be formed in the outer casing and/or comfort chamber. Also, in some embodiments a pocket might be attached to the exterior of the outer casing to cover the valve opening.

In use, the pillow might be self-inflated (typically to maximum inflation initially, or perhaps to a level that the user deems comfortable) by opening the valve in the absence of external pressure or force upon the pillow. The valve may be closed at any time during self-inflation of the core if the pillow reaches a desired level of comfort based on the user's preference. If the user desires a less firm and/or less thick pillow, the user might open the valve while applying pressure/force to the pillow (which may cause air in the inner core to evacuate through the fluid conduit and the valve, thereby deflating the inner core). Once the user's desired level of firmness and/or thickness has been achieved, the user might close the valve so that the pillow may remain at that level. Upon closure of the valve, the homogenous resilient material(s) may quickly redistribute the air in the pillow to provide for a relatively flat sleeping surface. If the user then desires to further reduce the firmness and/or thickness of the pillow, then the user might open the valve again while applying pressure/force to the pillow, until the pillow reaches the new desired level (at which point the user might close the valve). Alternatively, if the user then desires to increase the firmness and/or thickness of the pillow, the user might open the valve while there is no force or pressure applied to the pillow, and the pillow may self-inflate (until it reaches the new desired level, at which point the user may close the valve). Thus, the user might adjust the pillow by either opening the valve while the pillow is experiencing external pressure/force (which would deflate the pillow), or by opening the valve when there is no external pressure/force on the pillow (which would allow the pillow to self-inflate). The selected level of firmness and/or thickness for the pillow might then be set by closing the valve (so that it would then remain approximately constant regardless of application of pressure/force on the pillow). Typically, the pressure/force used to deflate the pillow might be the weight of the user's head on the pillow and/or application of pressure/force by the user (for example by the user squeezing or pressing on the pillow). So typically, the pillow comfort may be customized based on user preference without the use of a pump. In other embodiments using a pump, however, a pump might instead be used to inflate and/or deflate the pillow. The user could initially set the desired comfort (for example firmness and/or thickness) level of the pillow the first time using the pillow based on user preference. The user could change the selection of desired firmness and/or thickness level for the pillow based on changes in the user's sleep position, for example, Additionally, different users might set the pillow to their individual comfort level preference, allowing a single pillow to work more effectively for multiple users (at different times). This could prove especially useful if the pillow is provided in a guest bedroom or hotel room, for example, since the pillow may need to serve the needs of many different users having different pillow preferences.

Alternatively, the pillow might be used with the valve always open (in which case, the self-inflating inner core need not even have a valve in some embodiments), allowing the pillow to self-adjust throughout changing conditions experienced during usage of the pillow. This might allow the pillow to automatically inflate or deflate as needed based on the user's changing sleep positions throughout the night, for example. Without a closed valve during usage of the pillow, the user may not be able to select and set a personalized comfort level; however, the pillow might self-adjust to changing conditions (for example if the user changes sleeping positions).

Although the above embodiments and methods make reference to pillows, persons of skill should understand that this disclosure is not so limited. Rather, embodiments and methods might relate to a variety of cushioned support devices having a self-inflating inner core. For example, embodiments and methods might relate to pillows, mattresses (or mattress components), mattress toppers, seat cushions, and/or bean bag type devices.

While various embodiments in accordance with the principles disclosed herein have been shown and described above, modifications thereof may be made by one skilled in the art without departing from the spirit and the teachings of the disclosure. The embodiments described herein are representative only and are not intended to be limiting. Many variations, combinations, and modifications are possible and are within the scope of the disclosure. Alternative embodiments that result from combining, integrating, and/or omitting features of the embodiment(s) are also within the scope of the disclosure. Accordingly, the scope of protection is not limited by the description set out above but is defined by the claims which follow, that scope including all equivalents of the subject matter of the claims. Each and every claim is incorporated as further disclosure into the specification and the claims are embodiment(s) of the present invention(s). Furthermore, any advantages and features described above may relate to specific embodiments, but shall not limit the application of such issued claims to processes and structures accomplishing any or all of the above advantages or having any or all of the above features.

Additionally, the section headings used herein are provided for consistency with the suggestions under 37 C.F.R. 1.77 or to otherwise provide organizational cues. These headings shall not limit or characterize the invention(s) set out in any claims that may issue from this disclosure. Specifically and by way of example, although the headings might refer to a "Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a limiting characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of the claims shall be considered on their own merits in light of this disclosure, but should not be constrained by the headings set forth herein.

Use of broader terms such as comprises, includes, and having should be understood to provide support for narrower terms such as consisting of, consisting essentially of, and comprised substantially of. Use of the term "optionally," "may," "might," "possibly," and the like with respect to any element of an embodiment means that the element is not required, or alternatively, the element is required, both alternatives being within the scope of the embodiment(s). Also, references to examples are merely provided for illustrative purposes, and are not intended to be exclusive.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A pillow comprising:

an outer casing;

a self-inflating inner core located within the outer casing;

wherein the inner core further comprises an air impermeable cover enclosing resilient open cell foam and a housing having a passage therethrough, an inner end of the housing directly contacting the foam within the impermeable cover with the inner end having a curvature matching a curvature of the contacted foam; and wherein the inner core is in fluid communication with an external environment beyond the outer casing through the housing.

2. The pillow of claim 1, wherein the inner end of the housing further comprises a center and two lateral edges, and wherein the inner end of the housing has a thickness profile that thins while widening from the center towards the edges.

3. The pillow of claim 1, wherein the housing further comprises an outer end outside the impermeable cover, wherein the passage through the housing comprises a core opening in the inner end and a conduit opening in the outer end, and wherein the core opening has a surface area greater than that of the conduit opening.

4. The pillow of claim 1, wherein the housing is located in a corner of the inner core.

5. The pillow of claim 1 further comprising a fluid conduit, having an inner end and an outer end, and a valve; wherein the valve is in fluid communication with the outer end of the fluid conduit, wherein the inner end of the fluid conduit is in fluid communication with the passage through the housing, wherein the valve is located with respect to the outer casing to provide fluid communication between the inner core and the external environment, and wherein the housing is more rigid than the fluid conduit.

6. The pillow of claim 5, wherein the valve is a two-way valve.

7. The pillow of claim 6 further comprising a top surface, a bottom surface, and a comfort layer of comfort material located between the inner core and at least one surface of the outer casing.

8. The pillow of claim 7 further comprising a comfort chamber associated with at least one surface of the pillow and containing the comfort material, wherein the comfort chamber comprises a retaining sheet.

9. The pillow of claim 7, wherein the comfort layer has an uncompressed IFD of about 9-12, and wherein the resilient open cell foam of the inner core has a density of about 1.8-2,2 pounds per cubic foot and an uncompressed III) of about 16-20.

10. The pillow of claim 5, further comprising a pocket which is located on an exterior surface of the outer casing, and a valve opening, wherein the valve protrudes out of the valve opening and is contained within the pocket.

11. The pillow of claim 6, wherein the valve is a tap valve.

12. A pillow comprising:

an outer casing;

a self-inflating inner core located within the outer casing;

wherein the inner core further comprises an air impermeable cover enclosing resilient material forming a matrix operable to contain a fluid;

wherein the inner core is in fluid communication with an external environment beyond the outer casing through a valve; and wherein the outer casing comprises a separate pocket located on an exterior surface of the outer casing, the pocket having an approximately triangular shape and spanning one corner of a surface of the outer casing, the pocket enclosing the valve.

13. The pillow of claim 12, wherein the resilient material forming a matrix operable to contain a fluid comprises resilient open cell foam, and wherein the impermeable cover is bonded to the resilient open cell foam.

14. The pillow of claim 12, wherein the valve comprises a rubberized, cushioned, or padded surface.

15. The pillow of claim 12, wherein the outer casing further comprises a valve opening through Which the valve protrudes, and wherein the valve opening is located within the pocket.

16. A pillow comprising:

an outer casing having a top surface a bottom surface and at least two side surfaces;

a self-inflating inner core located within the outer casing; and a comfort layer of comfort material located between the inner core and at least one surface of the outer casing;

wherein the inner core further comprises an air impermeable cover enclosing resilient open cell foam; and wherein the inner core is in fluid communication with an external environment beyond the outer casing; and further comprising, at least one comfort chamber associated with at least one surface of the outer casing and having a retaining sheet which contains the comfort material of the at least one comfort chamber between the inner core and the associated surface of the outer casing, with the retaining sheet being attached to the outer easing to form the comfort chamber wherein the retaining sheet positions the comfort material so that there is substantially no comfort material proximate any of the at least two side surfaces.

17. The pillow of claim 16, wherein the retaining sheet is formed of a low coefficient of friction material operable to improve insertion of the inner core.

18. The pillow of claim 16, further comprising two comfort chambers containing the comfort material, wherein the top surface of the outer casing comprises four sides and the bottom surface of the outer casing comprises four sides, wherein the two comfort chambers comprise a top comfort chamber associated with the top surface of the outer casing and a bottom comfort chamber associated with the bottom surface of the outer casing, wherein each comfort chamber comprises a retaining sheet having four sides, Wherein the four sides of the retaining sheet of the top comfort Chamber are attached to the corresponding four sides of the top surface of the outer casing, and wherein the four sides of the retaining sheet of the bottom comfort chamber are attached to the corresponding four sides of the bottom surface of the outer casing.

19. The pillow of claim 16, wherein the resilient open cell foam of the inner core comprises polyurethane foam having a density of about 1.8-12 pounds per cubic foot and an uncompressed IFD of about 16-20.

20. The pillow of claim 19, wherein the impermeable cover of the inner core comprises urethane film having a thickness of about 5 mil, and wherein the at least one comfort chamber has a thickness of about 3-3.5 inches.

* * * * *